United States Patent [19]

Andersson et al.

[11] Patent Number: 4,899,511

[45] Date of Patent: Feb. 13, 1990

[54] POST CONSTRUCTION KIT

[75] Inventors: Erland Andersson, Gustavsberg; Tage Skönvall, Hökerum, both of Sweden

[73] Assignee: Gustavsberg VVS Aktiebolag, Gustavsberg, Sweden

[21] Appl. No.: 174,766

[22] Filed: Mar. 29, 1988

[30] Foreign Application Priority Data

Mar. 30, 1987 [SE] Sweden ..... 8701331

[51] Int. Cl.[4] ..... E04H 12/08

[52] U.S. Cl. ..... 52/292; 52/721; 52/726

[58] Field of Search ..... 52/296, 721, 148, 726, 52/146, 292; 405/251, 231; 285/332

[56] References Cited

U.S. PATENT DOCUMENTS

| | | | |
|---|---|---|---|
| 232,360 | 9/1880 | Milliken | 52/726 |
| 862,152 | 8/1907 | German | 52/721 |
| 1,342,847 | 6/1920 | Gray | 52/726 |
| 2,016,011 | 10/1935 | Kent | 52/726 |
| 2,162,675 | 6/1939 | Lingo | 52/148 |
| 2,410,246 | 10/1946 | Scrivener | 52/148 |
| 3,270,480 | 9/1966 | Beecker | 52/721 |
| 3,325,950 | 6/1967 | Pfaff | 52/721 |
| 4,076,281 | 2/1978 | Davis | 52/220 |
| 4,314,434 | 2/1982 | Meisberger | 52/721 |
| 4,543,218 | 9/1985 | Bardo | 52/630 |
| 4,569,617 | 2/1986 | Schmidt et al. | 405/251 |

FOREIGN PATENT DOCUMENTS

| | | | |
|---|---|---|---|
| 364146 | 9/1981 | Austria . | |
| 37731 | 7/1927 | Denmark . | |
| 2708664 | 9/1977 | Fed. Rep. of Germany . | |
| 244210 | 4/1947 | Switzerland | 52/148 |

*Primary Examiner*—John E. Murtagh

*Attorney, Agent, or Firm*—Nils H. Ljungman

[57] ABSTRACT

A post construction kit for constructing a post implanted in a base terrain which includes a first post section adapted for implantation in the base terrain, at least one other post section adapted for interconnection with the post section to be implanted underground, and an interconnecting arrangement for interconnecting the underground section and at least one other post section.

17 Claims, 2 Drawing Sheets

POST CONSTRUCTION KIT

BACKGROUND OF THE INVENTION

1. Field of the Invention

The present invention relates to a post or mast structure, which is particularly adapted to support a load above ground level, preferably an elongated load. This load may represent an object, which is supported by a plurality of mutually coacting posts, such as an overhead power line, or an elongated object which is supported solely by a single post and which projects outwardly on one side thereof, or which projects in balance from both side of the post.

2. Description of the Prior Art

Posts, or masts, are to be found in many different forms and for many different purposes, ranging from lattice-work mast structures for carrying 400 kV overhead power lines down to fencing posts of 50 mm in diameter. The posts may be grouted in the ground or simply secured by burying one end of the post in a pit or hole formed in the ground and by compacting natural stone around the post, so as to hold the post firmly. Flag posts and sign posts can be said to constitute particular examples of the posts referred to here.

The economic significance of a novel type of post depends upon the cost of and the type of post the novel post is intended to replace and the number of posts involved. In Sweden, more than eight million wooden posts are used today for supporting overhead power lines and telecommunication lines. By present day standards, an impregnated wooden post of this kind is estimated to have an active useful life of 40 years. There exist today overhead power line installations which are 50 years old and in which not a single post has needed to be replaced, although 40 years is the recognized useful life span of a wooden post. The mechanical strength of the post is calculated to be so impaired after this length of time as to render the post unsuitable and in need of replacement. It will be appreciated that the useful life span of such posts will be progressively shorter in the future, since the wood from which present day posts are produced and the wood from which posts have been recently produced is not of the same quality as that upon which present day standards have been based.

In addition to the scarcity in modern forests of rooted trees, which are suitable to be used for wood for posts for overhead power lines in excess of 10 kV, the impregnation of such now available wood has presented pronounced problems. The impregnating agent used hitherto, i.e. creosote tar, has been classified as toxic by the authorities. Consequently, anyone working with creosote impregnated posts must wear special protective clothing. Another drawback with creosote impregnated posts is that they may not be stored in the open air, due to the fact that the impregnation methods used result in moist posts, caused by incomplete absorption of the creosote tar and manifested in sticky wood surfaces.

Arsenic-copper salt solutions are alternative impregnating agents to creosote tar but, since these solutions have a shorter effective life span than creosote, they are not as economically viable. When considering the problems represented by the deterioration in the natural surroundings when facilities for impregnating wood are present which use such impregnating solutions, it is seen that the increased use of such solutions is counter-productive to the endeavor to provide improved environmental conditions.

Overhead power lines intended for more than 70 kV are supported by lattice-work posts or masts. In addition to being expensive to manufacture, such masts are highly unaesthetic and present an ugly feature in the surrounding landscapes. The need for power lines is increasing with the increasing need for electrical energy from progressively increasing production units to progressively higher consumer concentrations. In many areas or districts, this has resulted in multiple power cables or lines being erected in parallel. The posts or masts involved herewith detract greatly from the surrounding countryside and, in addition, present obstacles to agricultural machines working in the area. The same applies to posts used to carry telecommunication lines, although in this case the posts are not as high as the masts used to carry power lines and are not, therefore, as equally discernible to the eye.

Attempts, to reduce the extent to which such posts or masts encroach upon cultivated agricultural land, have resulted in power lines being run across land which is not used for agricultural purposes or across marshy territory. However, the erection of power of telecommunication line masts or posts in this latter territory is both difficult and laborious. Certain posts need to be anchored with the aid of dolphin-like shoring structures, and sometimes with the aid of some twenty or so auxiliary supportive posts.

Because of the limited flexibility of a wooden post, it is necessary to shore the post when a change in power or telecommunication line direction is effected, even though this directional change may be only moderate. The costs involved include the cost of the shores and tensioning devices required, e.g. bottle screws, and also the additional cost of the necessary concrete foundations or horizontal subsoil anchoring posts and the excavation work that needs to be undertaken in conjunction therewith.

The method used hitherto for erecting wooden posts for different purposes is one in which a pit is dug to a prescribed depth, in the case of posts for carrying 10 kV cables, a depth of 1.40 m, whereafter the root end of the post is placed in the pit and the post is lifted to a vertical position. The pit, or hole, is then fitted with available screened aggregate and the post is brought to a truly vertical position prior to filling in the pit and finally consolidating the packing material. The work of preparing post pits has been facilitated for many years by the use of earth drills and tractor carried vertical diggers. However, the ground surrounding the pits is often uneven or is inclined, which results at times in incomplete compaction of the aggregate intended to anchor the posts.

Another drawback with known wooden post support structures is that when two such posts are used to support a transformer, and even when four such posts are used for this purpose, and when one of the posts used becomes defective and must be changed, it is necessary to disconnect the transformer and lower it to ground level before the post can be changed. Subsequent to replacing the defective post, the transformer has to be lifted back into position and reconnected. Even though it is possible to plan the work involved, it necessitates an interruption in the power supply, which may be troublesome. As will be understood, it is necessary to restrict the future use of wooden posts, not only because of the aforementioned toxic risk presented by impregnated posts, but also because wooden posts are attacked by insects, or pests, other than those normally classified as infestants, or parasites, even though the posts have been thoroughly impregnated. It has been found in recent years that wooden posts are attacked by the black housefly (*Campanatus liquiperda*) and the red ant (*Formica nufa*), to an extent which is on a par with the damage caused by woodpeckers, fungi and mold. The latter cause mainly superficial damage, whereas the ants attack the core of the wood itself. The reason for this is probably because the core of the post is unable to absorb the impregnating agent used, since the wood resin is impregnable and impermeable to the impregnates used, and secondly because the natural habitats for ants have been greatly restricted by modern forestry. This, together with clear cutting of entire forests and subsequent ground preparation, has decimated all protective locations where ants may build their stacks. Ants, which live in stacks, and also horse flies to some extent, normally lay their eggs in tree stubs and dry furrows. When the ground is finally cleared and such stubs and furrows can no longer be found in the area, power line posts become the natural habitat of the ants.

The problems recited in the aforegoing with regard to cable or wire carrying posts apply with varying degrees to all types of wooden posts, irrespective of whether they are used to support cableways, so-called ski lifts, fences, road signs, advertising signs, or as flag poles.

OBJECT OF THE INVENTION

One object of the present invention is the provision of a post or like structure which, when dimensioned for its intended function is able to carry the load involved, irrespective of whether this load is represented by a road safety fence, which extends less than one meter above road level, or by a high-tension power line supported at a height of more than 20 meters above ground level.

SUMMARY OF THE INVENTION

An aspect of the invention resides in a post construction kit for constructing a post implanted in a base terrain, the post construction kit comprising: at least a first post section adapted for implantation in the base terrain; at least a second post section, at least one of the second post section being adapted for interconnection with at least one first post section; and interconnecting arrangement for interconnecting at least one first post section and at least one second post section.

The object is achieved with a post constructed in accordance with the invention. When seen from the aspect of the costs involved in erecting a post according to the present invention, one important feature of the inventive post is that no pit or hole is required. Instead, a first section of the post, which forms a post foundation, is hammered or likewise driven into the ground. In the case of posts which are 50 mm in diameter, the posts may be continuous, single piece structures and are preferably driven into the ground to a depth of about 50 cm. In the case of posts which are intended to support overhead power lines and which are to be erected on marshy ground, this first post section may not be long enough to achieve firm frictional engagement with the surrounding soil or earth, and consequently it may be necessary to drive a further post section into the ground in order to achieve the requisite degree of friction. Thus this obviates the need of pile driving to refusal.

Shorter posts may be driven into the ground with the aid of hydraulically operated drivers. In the case of posts of the very largest dimensions, the aforesaid first post section can be driven into the ground with the aid of a tractor carried, pneumatic or hydraulic high speed hammer. It has been found in practice that this method can be applied also with respect to frozen ground, and that the first or foundation-forming post section can be driven into such ground in a matter of only some few minutes.

Because the various post sections of a multisection post, according to the invention, are preferably of tubular configuration and provided with a socket coupling at one end and a conically tapered spike at the other, the sections can be readily assembled to form a continuous post. The conicity of the tapered, spiked end of respective post sections is preferably such that the joint formed between two mutually adjacent post sections is self-locking, such that the post will withstand relatively large loads, more specifically both the load exerted axially by the object carried by the post and also the bending stresses created, e.g., at the juncture where a change in cable direction is made. The post sections are also preferably made of ductile iron, thereby improving the flexural strength of the post still further. Ductile iron is relatively resistant to corrosion, and by coating the hollow tubular posts with asphalt, both internally and externally, to a thickness of at least 50 microns, in accordance with one preferred embodiment of the invention, the posts can be given a useful active life of more than 100 years.

Since that section of the post, which is driven into the ground, is the section which is most subjected to corrosion, it may suffice in some cases to produce solely this section of the post from ductile iron. In certain instances it may be desirable, for environmental reasons, that the part of the post which is visible above the ground has a particular configuration. One conceivable instance in this regard is when a public thoroughfare is to be provided with new lamp posts which are required to conform to or blend with the existing character of nearby buildings. In this case, the advantages afforded by the novel post construction can be utilized to the full, because of the inclusion of the aforesaid drivable first post section of said construction. In the case of this particular embodiment of the inventive post, there is fitted to the first or foundation-forming post section at ground level, an auxiliary or transition post section to which the remainder of the post structure can be fitted. The remaining part of the post structure which extends above ground can be intentionally designed to suit prevailing aesthetic requirements. When newly manufacturing such parts, they are provided with a spiked end portion which fits at ground level into the socket of the first post section located in the ground and which is self-locking in said socket. This enables the inventive concept to be applied in respect of posts which are especially molded for use in highly exclusive environments.

The post section, which, in accordance with the invention, is driven into the ground, can be used as a foundation for other types of post. For example, that part of the post, which extends above ground level, may consist of a continuously tapering, or step-wise tapering galvanized steel tube. Wooden posts may also be fitted to the ground-located first post section. Furthermore, there is no restriction to posts of round cross-section, since it suffices that the connecting end of the overlying post section has a configuration which conforms to the configuration of the socket connector of the ground-located post section.

In the case of high posts which comprise a plurality of separate post sections, and particularly when an assembled post is to be erected with the aid of a tractor-carried digger, it may be beneficial to ensure that the various post sections are securely locked to one another prior to lifting the post. This can be effected by drilling a slightly conical hole through a connecting socket and the tapered end of an adjoining post section fitted thereinto, and by subsequently driving a lock pin into the hole.

In the case of inventive post constructions intended for supporting overhead power lines, an advantage is afforded when the ground-located first post section is fitted with a post shoe prior to being driven into the ground, the size of the post shoe used being dependent on the nature of the ground into which said post part is driven. The function of the post shoe is to form in the ground a hole whose transverse dimension is greater than the transverse dimension of the ground-located post section. This hole enables an erected post to be aligned truly with the vertical, whereafter the hole can be filled with loose aggregate in the vicinity of the ground-located post section. This will further reduce the risk of corrosion.

The ground-located part of the post may also be provided with preferably axially extending elongated slots. Subsequent to having driven the ground-located post section to the intended ground depth, concrete is pumped thereinto and exits through the slots. When a sufficiently large post shoe is used, the ground-located post section will be surrounded by concrete, thus creating a firm foundation.

Ductile iron, such as nodular iron, is well suited for the manufacture of post sections by centrifugal casting methods. The above-ground post sections can therewith readily be given a configuration which tapers towards the spiked ends of respective sections. Since the ground-located post section is normally driven into the ground with its spiked end facing downwards, the connecting socket of this post section is fitted with an auxiliary, transition post section which is spiked at both ends. This enables the above-ground sections of a multiple section post assembly to be assembled with the connecting sockets facing downwards. Furthermore, the auxiliary post part may comprise a multiple of very short post sections, which are used between two mutually adjacent above-ground post sections for dimension changing purposes. This enables very high post constructions to be given a diameter, which decreases with each further post section above ground level, normally with each five meters of post length.

Since the post is of hollow tubular construction, the upper end of the post will be open. It is therefore preferred to fit to the end of the top post section a cap or like cover member, preferably a capping sleeve. In the case of posts which are intended to carry overhead electrical conductors, the capping sleeve is made of the same material as the post, since materials of mutually different electropotential in the electrochemical series of metals are liable to induce corrosion in the magnetic field surrounding the conductors, particularly in the presence of rain water and a contaminated atmosphere.

When the inventive posts are used in groups of twos or threes, for example to support high tension lines and larger ski lifts, it is preferable to connect together the tops of the respective posts or masts with the aid of connecting elements. These elements may consist of lengths of conventional angle iron secured to respective posts with the aid of conventional fasteners, such as nuts and bolts. The connecting elements or attachment devices therefore may also be welded to respective iron parts. An alternative solution, however, is to place over the tops of respective posts a tubular post section, which lacks the provision of connecting sockets and has a larger diameter than the tops of said posts, and which is provided with at least two apertured recesses at a mutual distance apart equal to the distance between the tops of the posts. This hollow tubular connecting element may, of course, be secured to respective posts with the aid of suitable fasteners. Alternatively, the apertured recesses may be given the same configuration as the top ends of the post, so as to engender a self-locking effect. It will be understood that if the posts are inclined towards one another, the apertures must be formed at an angle of less than 90° to the longitudinal axis of the connecting element.

The surfaces of the posts will normally be treated with an asphalt emulsion, although they may alternatively be painted in any desired color.

In general, the invention features a post construction kit for constructing a post implanted in a base terrain, the post construction kit including a first post section adapted for implantation in the base terrain, a second post section adapted for interconnection with the first post section, and interconnecting means for interconnecting the first and second post sections.

BRIEF DESCRIPTION OF THE DRAWINGS

The invention will now be described in more detail with reference to a number of exemplifying embodim ents thereof and with reference to the accompanying drawings, in which.

DESCRIPTION OF THE PREFERRED EMBODIMENTS

Figure 1:
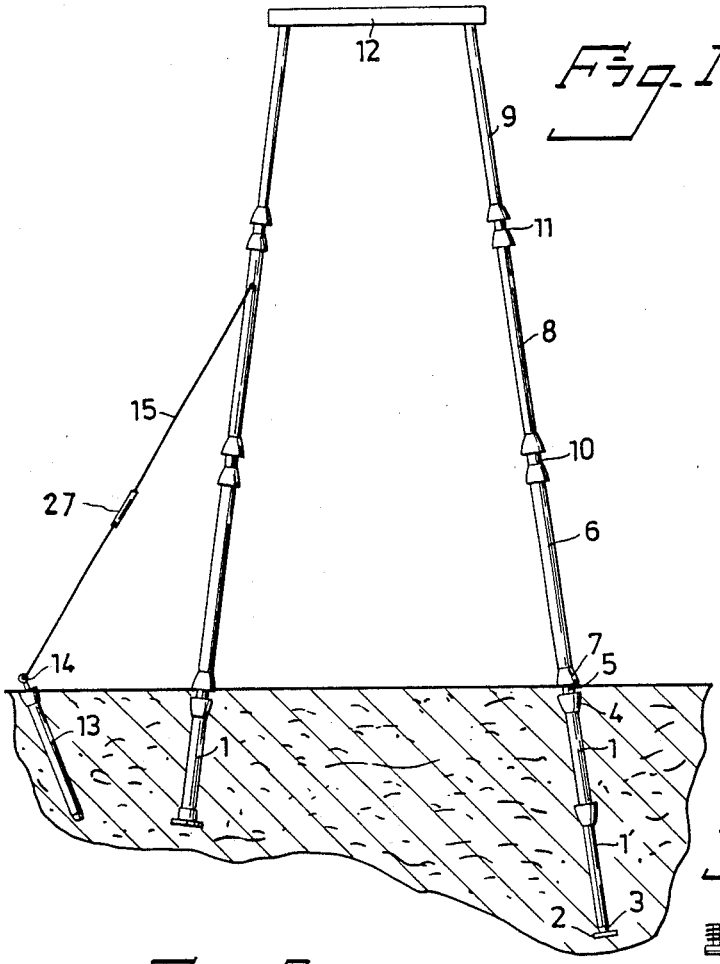
FIG. 1 illustrates a post or mast construction intended for supporting overhead high-tension power lines.

The illustrated post construction includes a tubular post section 1 which is hollow and cylindrical and which is intended to be driven into the ground so as to provide a post foundation therein and to which there is fitted a pole shoe 2. One end 3 of the foundation-forming post section 1 is spiked and the pole shoe is fitted to this spiked end by means of legs (not shown) which extend upwardly internally of said post section, or with the aid of a connecting socket which embraces said spiked end 3. The opposite end of the foundation forming post section 1 is provided with a conical connecting socket 4 into which there is inserted an auxiliary or bridging post section 5, the two ends of which have a spiked configuration which corresponds to the conicity of the socket 4. The socket 4 is located at the upper end of the post section 1. The socket 4 has a portion with an outer diameter which is greater than the diameter of the cylindrical portion of the post section 1. The outer surface of the socket 4 is flaring outwardly and upward so that the diameter at an upper portion is greater than the diameter of a lower portion of the outer surface of the socket 4. Fitted to the spiked end of the auxiliary post section 5 distal from the foundation forming post section 1 is the connecting socket 7 of a first above ground post section 6.

The socket 7 on the first above ground post section 6 has an internal conicity which coincides fully with the conicity of the upper spiked end of the auxiliary section 5. This conicity has a tapering ratio of at least 1:14 and at most 1:20, i.e. the diameter decreases one length unit in an axial direction over a maximum of 20 length units.

As illustrated in FIG. 1, a second, and optionally several, post sections 8, 9 can be fitted consecutively above the first above ground post section 6, the number of sections fitted being dependent on the desired height of the post assembly. When the load to be supported permits, the higher post section 8, 9 may have a diameter which decreases in relation to the underlying post section 6. This is achieved in accordance with the invention with the aid of adapters 10, 11 which are fitted between respective post sections 6, 8, 9 and which also serve to stabilize the joint between mutually adjacent post sections. The adapters have the form of very short post sections, of which the conicity and dimension of the connecting socket coincide with the conicity and the dimension of the connecting socket 7 of the first above ground post section 6, the adapter 10 being fitted to the spike end of said post section. In addition to length, a further difference between a diameter reducing adapter and a post section is that the spiked end of the adapter has a diameter which corresponds to the inner diameter of the connecting socket on the post section to be placed above the diameter decreasing adapter. The diameter-reducing adapters are preferably placed approximately 10 meters apart, even though shorter post sections may be used.

When erecting posts intended for supporting high tension power lines, it may be necessary to drive two or more foundation-forming post sections 1, 1' into the ground. These foundation-forming post sections are preferably configured in a similar manner to the aboveground post sections, i.e. each have mutually corresponding connecting sockets 4 and spiked ends 3 with self-locking facilities, as described above. These foundation-forming sections can be driven straight into the ground to provide a stable foundation at a requisite depth so as to provide the necessary support, even in ground which would not otherwise be considered suitable for the erection of such posts or masts.

Trestle-like post configurations are used for supporting high tension power lines of 130 kV. The supporting trestles comprise at least two posts which extend vertically or are inclined one towards the other and which are interconnected at the tops of their respective sections by means of a horizontal connecting bridge 12, which may comprise either a single post section or a number of interfitted post sections. The post section or sections forming the connecting bridge 12 must have a larger diameter than the post sections forming the limbs of the trestle-like structure. The holes required in the connecting bridge 12 to enable the bridge to be fitted over the pointed ends of the uppermost post sections can be formed with the aid of a conical boring tool provided in the high tension power line construction equipment and which has the same cutting angle as the spiked ends of respective post sections 9. The connecting bridge 12 can be anchored to the top post elements 9 with the aid of a vibrating device. Attachment devices for the insulators from which the high tension power lines are to be suspended are screwed firmly into the connecting bridge 12.

When it is necessary to further support a post, for example due to its height, there may be used a guy arrangement of the kind referenced 13, 14 and 15 in FIG. 1. The guy peg used to this end may comprise a foundation-forming post section 1, which may or may not be fitted with a driving shoe 2, or may comprise a post element of desired diameter which is driven into the ground at an acute angle to the surface thereof. Concrete is then poured into the hollow guy peg 13 and an eye bolt 14 is secured in the concrete. A guy wire 15 connected to the post at a suitable height thereon is then connected to the eye bolt 14 and tensioned, e.g., through the provision of an appropriate tensioning device 27. Alternatively, the eye bolt may comprise a guy wire which is wound around the post section beneath the connecting socket, therewith eliminating the need of filling the post section with concrete.

Figure 2:
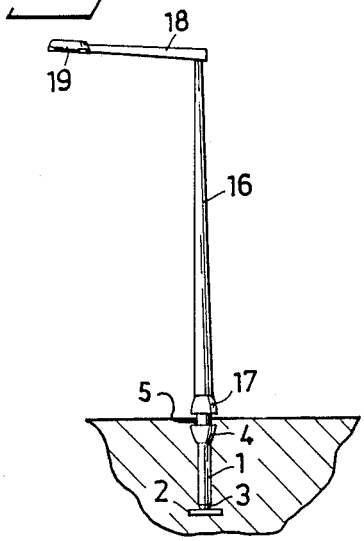
FIG. 2 illustrates a lamp post construction.

Referring now to FIG. 2, when the inventive post is to be used as a lamp post, the foundation-forming post section 1 is driven into the ground in the aforedescribed manner. Subsequent to fitting the auxiliary post section 5 into the connecting socket 4, the connecting socket 17 of a lamp post 16 is fitted over the upper spiked end of the auxiliary section 5. The post 16 preferably tapers continuously upwards and may consist of a single piece structure to a height of 5 meters. Fitted to the upper spiked end of the post 16 is a single arm or double arm element 18 which carries a lamp 19 at the extremity or extremities of its arm or arms 18. The electric wires required for connecting the lamp or lamps can be readily drawn through the hollow post as the post is being erected.

Figure 3:
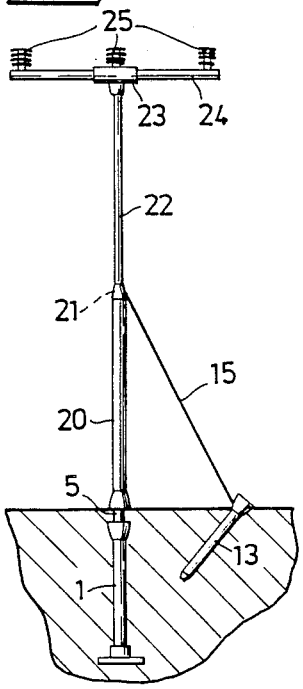
FIG. 3 illustrates a post construction for supporting power lines.

Referring now to FIG. 3, in the case of high lamp posts, there is applied the same technique as that applied when erecting, for instance, posts which are to support 20 kV power lines. The foundation-forming post section 1 is driven into the ground in the manner aforedescribed, whereafter a post section 20 is fitted over the auxiliary post section 5. The post section 20 of this embodiment differs from the aforementioned post sections, in that the spiked end 21 of the post section 20 decreases in diameter stepwise at the location where its cone begins to converge. The post section 20 has fitted thereto an overlying post section 22 which is provided with a connecting socket which has an outer diameter adapted for making a fitting relationship by having a dimension which is equal to the outer diameter of the post section 20. The post section 22 tapers upwards from the connecting socket to a given point on said section, whereafter the diameter of the section remains constant. Connected to a provided upper spiked end of the post section 22 is a T-piece 23, the vertical leg of which is configured as the connecting socket on one of the aforedescribed post sections. The horizontal part of the T-piece 23 has the form of a hollow sleeve of uniform diameter. Extending through the horizontal sleeve is a smooth iron tube which forms a crosspiece 24, which is secured to the T-piece 23 by means of a preferably conical locking pin which is driven into a hole drilled through the T-piece 23 and into the crosspiece 24. The crosspiece 24 is intended to support lamp fittings or power line insulators 25, whichever are required.

In the majority of cases, it is preferred to assemble at least the aboveground post sections on the ground. The post is assembled by placing the connecting socket 7 of the first above ground post section 6 against a firm abutment, whereafter the diameter reducing adapter 10 is fitted to the spiked end of the post section 6. The connecting socket of the second post section 8 is then fitted onto the adapter 10 and an annular vibrating device is placed around the connecting socket of the post section 8 (for example, around the top thereof) and the parts are hammered together. As an additional safety measure, a conical locking pin or like device can be driven into a hole drilled through each connecting socket and into the spiked end of a post section located in said socket. Assembly of the post is continued until the requisite number of post sections have been fitted together, whereafter the post is erected.

The assembled post can be raised with the aid of a relatively powerful tractor carried digger. The ground around the post has been highly compacted during the driving in of the foundation-forming section 1, which in itself contributes towards firming the support of the post. The use of a tractor carried digger affords a practical solution both when erecting a single post and when erecting a complete power line installation.

Figure 4:
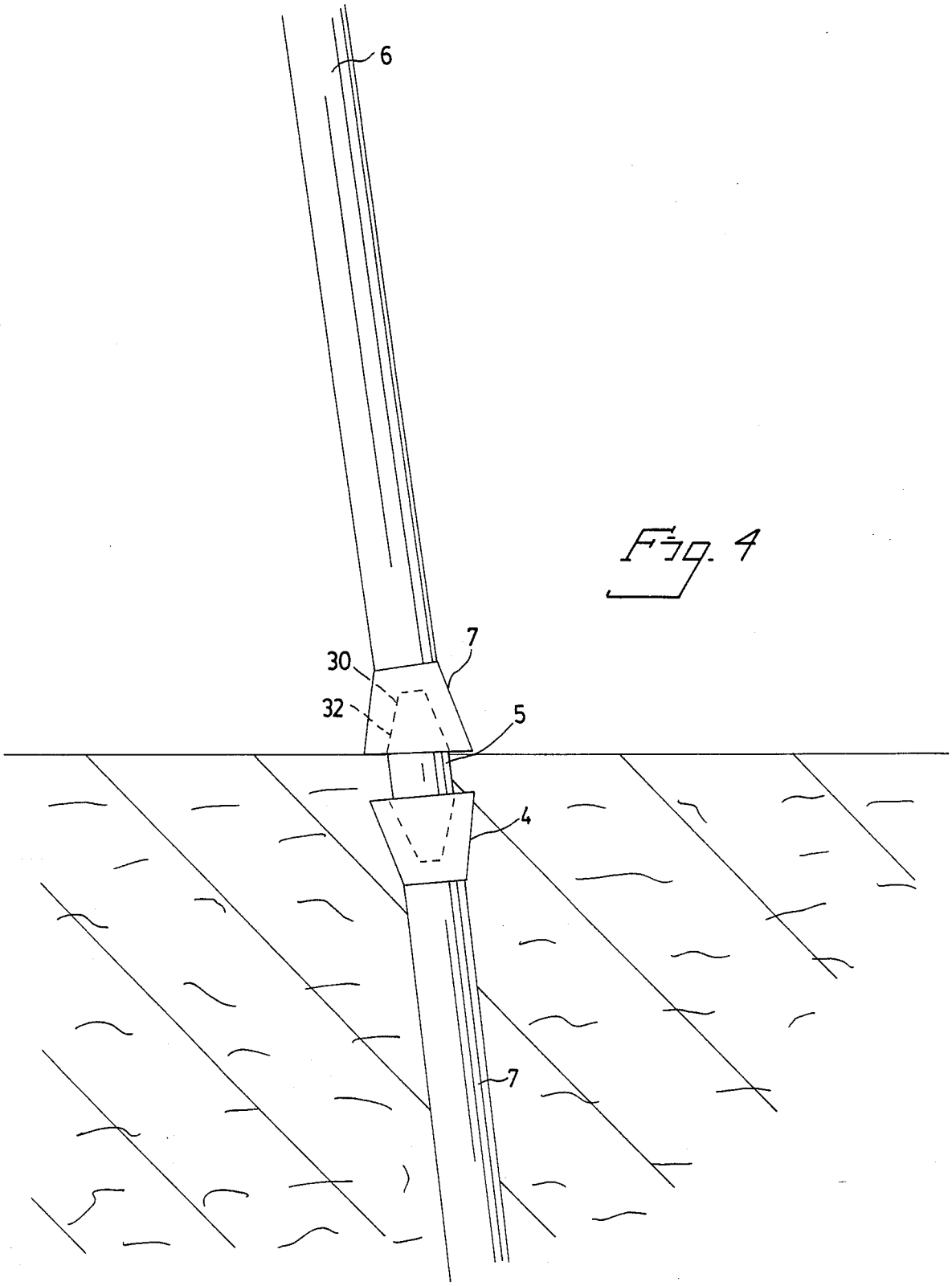
FIG. 4 illustrates the spikes portion and the socket portion between post sections

Referring now to FIG. 4, the socket 7 on the first aboveground post section 6 has an internal coincity 30 which coincides fully with the conicity 32 of the upper spiked end of the auxiliary section 5. The other sockets in the configuration and the other spiked ends have similar internal conicities and spiked ends.

In view of their very long useful life, posts constructed in accordance with the invention afford an economically advantageous alternative, particularly with regard to their reusability.

The invention as described hereinabove in the context of the preferred embodiments is not to be taken as limited to all of the provided details thereof, since modifications and variations thereof may be made without departing from the spirit and scope of the invention.

What is claimed is:

1. A post implanted in a base terrain, said post comprising:

at least a first post section implanted in the base terrain;

said at least first post section having at least one substantially cylindrical hollow tubular post portion; said at least first post section having interconnection means, said interconnection means comprising socket member means;

said at least first post section comprising centrifugally cast ductile iron;

said socket member means being disposed on the uppermost portion of said at least one substantially cylindrical hollow tubular post portion;

said socket member means having an outwardly tapered surface, said outwardly tapered surface being greater in diameter at an upper portion of the socket means than at a lower portion of the socket means, said outwardly tapered surface having at least one diameter being substantially greater than the diameter of the at least one substantially cylindrical hollow tubular post portion;

at least a second post section, said at least one of said second post section having a tapered protrusion at an end thereof for interconnection with said socket member means of said at least one first post section, said tapered protrusion comprising a portion of said interconnecting means;

said socket member means of said at least one substantially cylindrical hollow tubular post portion having an internal conical portion being disposed for receiving and holding said tapered protrusion of said at least a second post section from above; and said interconnecting means interconnecting said at least one first post section and said at least one second post section.

2. The post according to claim 1, wherein said post comprises a member of the group comprising a power line pole, a lamp post, a ski lift tower and a cable car tower.

3. The post section according to claim 1, wherein said socket member means provides a self locking connection.

4. The post according to claim 3, wherein said tapered protrusion comprises a spike shaped member.

5. The post according to claim 1, wherein said interconnection means comprises an additional member for engaging both said at least one first post section and said at least one second post section.

6. The post according to claim 3, wherein said interconnection means comprises an additional member for engaging both a pair of at least one said first post section and said at, least one second post section.

7. The post according to claim 4, wherein said tapered protrusion has a tapering ratio of between about 1:14 and 1:20, wherein the first of said tapering ratio numbers refers to a transverse dimension of said tapered protrusion and the second of said tapering ratio numbers refers to an axial dimension of said tapered protrusion.

8. The post according to claim 1, wherein said at least one first post section comprises a substantially tube shaped member.

9. The post according to claim 4, wherein said socket member comprises a conical recess provided in one of said at least one first post section and said at least one second post section and wherein said spike shaped member and said conical recess are dimensioned so as to interlock when mutually engaged.

10. The post according to claim 8, wherein said socket member comprises a conical recess provided in one of said at least one first post section and said at least one second post section and wherein said spike shaped member and said conical recess are dimensioned so as to interlock when mutually engaged.

11. The post according to claim 1, wherein at least one of said at least one second post section comprises ductile iron.

12. The post according to claim. 4, wherein said at least one second post section comprises ductile iron.

13. The post according to claim 1, wherein at least one of said at least one first post section and said at least one second post section is of hollow tubular construction and is coated, both internally and externally, with asphalt.

14. The post according to claim 9, wherein said at least one first post section and at least one second post section has substantially similarly configured external surfaces in the region of said interconnection means, said conical recess and said spike shaped member being located interior of said external surfaces, whereby a substantially continuous profile is produced, in the region of said interconnection means, by the interconnection of said at least one first post section and said at least one second post section.

15. The post according to claim 10, wherein said at least one first post section and at least one second post section has substantially similarly configured external surfaces in the region of said interconnection means, said conical recess and said spike shaped member being located interior of said external surfaces, whereby a substantially continuous profile is produced, in the region of said interconnection means, by the interconnection of said at least one first post section and said at least one second post section.

16. The post according to claim 1, wherein said at least one first post section comprises an elongated member, a first extremity of said elongated member being provided with said interconnection means and a second extremity of said elongated member being provided with a foot member, said foot member comprising a region of increased transverse dimension provided on said at least one first post section.

17. The post according to claim 3, wherein said at least one first post section comprises an elongated member, a first extremity of said elongated member being provided with said interconnection means and a second extremity of said elongated member being provided with a foot member, said foot member comprising a region of increased transverse dimension provided on said at least one first post section , said foot member including a shoe at an extremity of said at least one first post section.

* * * * *